United States Patent [19]

Jones, III et al.

[11] Patent Number: 4,738,177

[45] Date of Patent: Apr. 19, 1988

[54] PRECISION CUTTING INSTRUMENT FOR PREPARING IMMUNOASSAY STRIPS

[75] Inventors: Thomas H. Jones, III, Thurmont; Maurice M. Smith, Rockville, both of Md.

[73] Assignees: Biotech Research Laboratories, Inc., Rockville; SNS Incorporated, Kensington, both of Md.

[21] Appl. No.: 841,312

[22] Filed: Mar. 19, 1986

[51] Int. Cl.[4] ..... B26D 1/04

[52] U.S. Cl. ..... 83/455; 83/614; 83/620

[58] Field of Search ..... 83/455, 466.1, 614, 83/620, 858, 856; 30/304, 305

[56] References Cited

U.S. PATENT DOCUMENTS

| | | | |
|---|---|---|---|
| 179,645 | 7/1876 | Cassidy . | |
| 289,594 | 12/1883 | Zieger | 83/614 X |
| 869,057 | 10/1907 | Cairncross | 83/455 |
| 1,626,550 | 4/1927 | Miller | 83/858 X |
| 1,778,161 | 10/1930 | Miller . | |
| 2,013,893 | 9/1935 | Matthews | 83/455 |
| 2,023,911 | 12/1935 | Boughton | 83/455 |
| 2,197,650 | 4/1940 | Piper et al. | 30/304 |
| 2,409,203 | 10/1946 | Gale | 83/614 X |
| 2,594,932 | 4/1952 | Judelson . | |
| 3,543,627 | 12/1970 | Hearns | 83/466.1 X |
| 3,703,918 | 11/1972 | Borner | 83/425.3 |
| 3,724,071 | 4/1973 | Hurtubise | 30/304 X |
| 4,230,008 | 10/1980 | Fornwalt et al. | 83/456 |
| 4,290,196 | 9/1981 | Borner | 30/122 |
| 4,452,991 | 6/1984 | Batchelor et al. | 549/383 |

FOREIGN PATENT DOCUMENTS

| | | | |
|---|---|---|---|
| 1009217 | 5/1952 | France | 83/466.1 |
| 969431 | 9/1964 | United Kingdom | 83/455 |
| 987669 | 3/1965 | United Kingdom | 83/455 |

OTHER PUBLICATIONS

Falcon Print Trimmer Advertisement, Falcon Safety Products, Inc., Mountainside, NJ.

*Primary Examiner*—Frank T. Yost

[57] ABSTRACT

An apparatus for obtaining highly uniform thin rectangular strips from solid support sheets, such as antigen-laden nitrocellulose sheets used in immunoassays, is disclosed which includes a rectangular-shaped base plate having longitudinal parallel grooves, a hinged rectangular-shaped top plate having longitudinal parallel slots and a fastening element to secure the top plate to the base plate so that the longitudinal slots of the top plate register precisely above the longitudinal grooves of the base plate. The apparatus also includes cutting blades, a holder for holding the cutting blades, a sliding mechanism to move the holder and the blades through the longitudinal parallel slots, solid support sheet and across the longitudinal parallel grooves, and hold down bars and trackways to guide the cutting blades through the longitudinal parallel slots and across the longitudinal parallel grooves.

7 Claims, 4 Drawing Sheets

FIG. 1
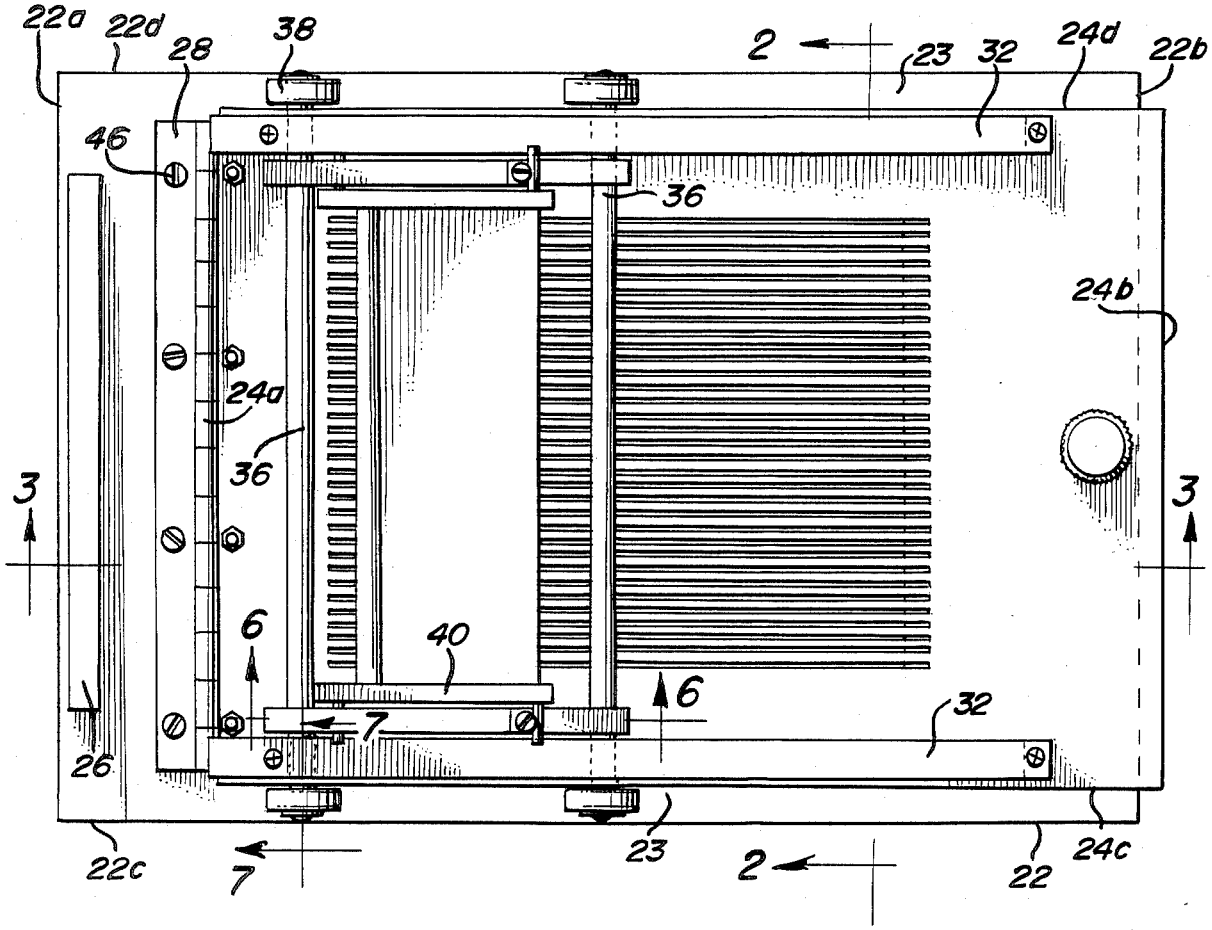
FIG. 2
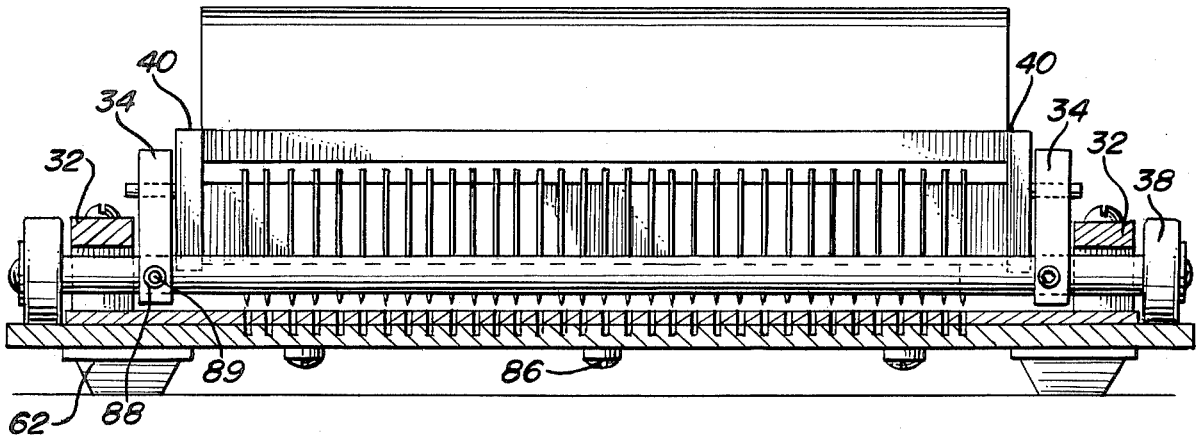
FIG. 9
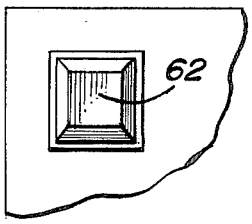
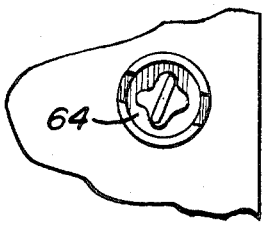
FIG. 10

FIG. 4
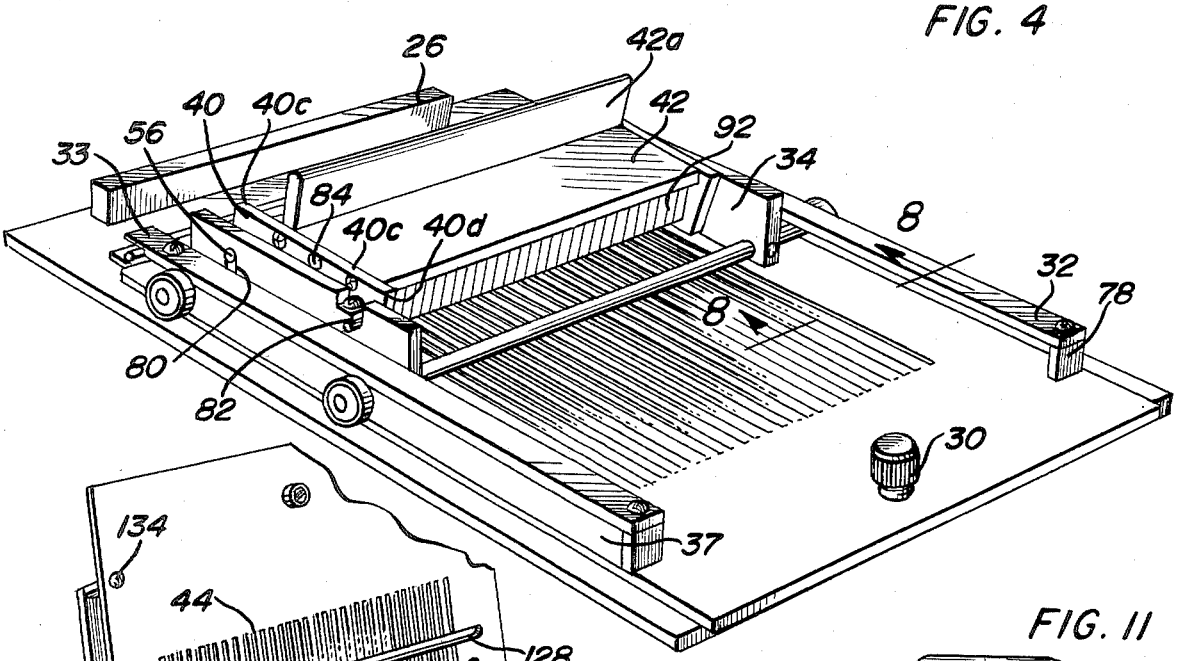
FIG. 11
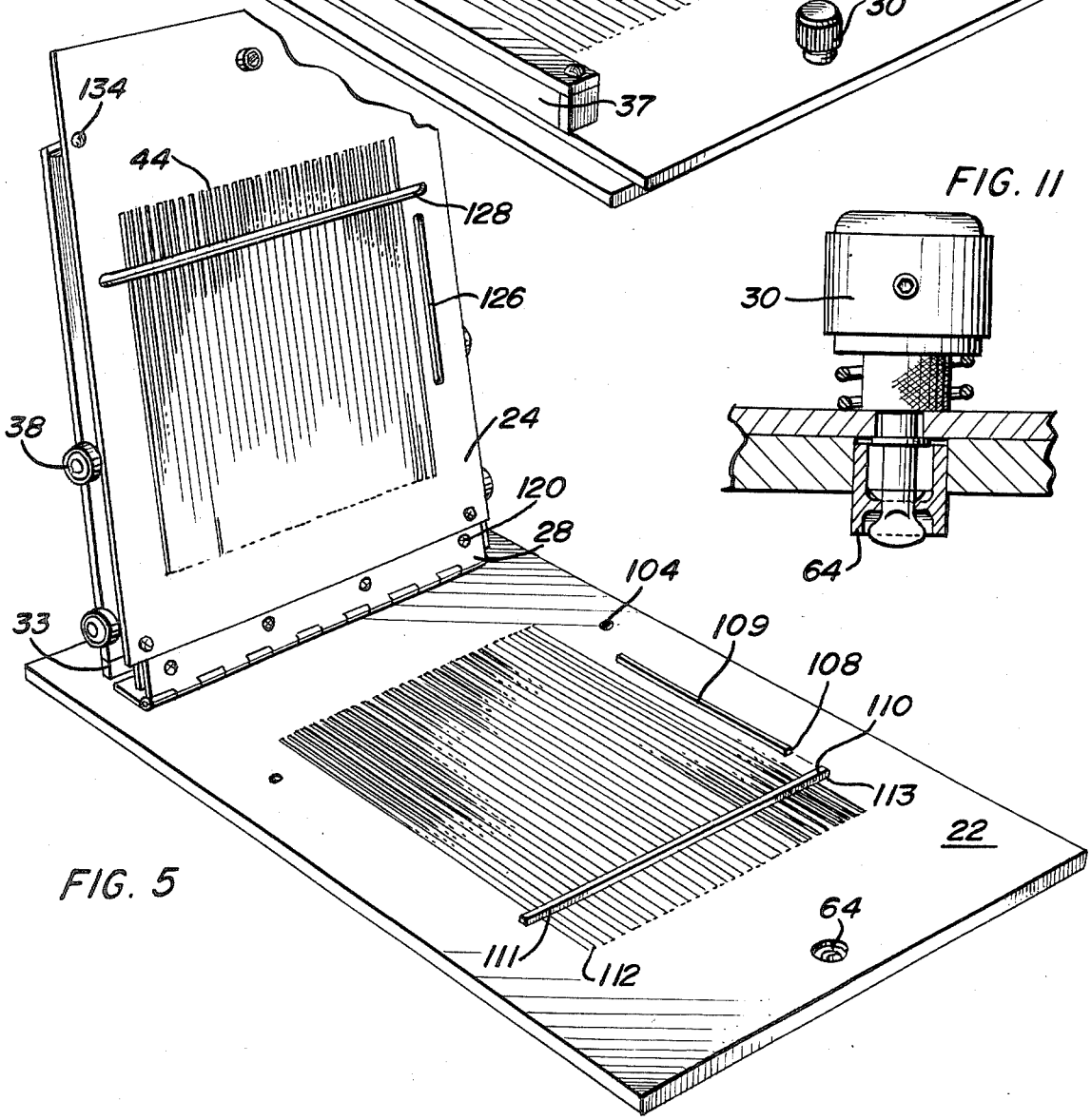
FIG. 5

PRECISION CUTTING INSTRUMENT FOR PREPARING IMMUNOASSAY STRIPS

BACKGROUND OF THE INVENTION

1. Field of the Invention

The present invention relates to a device for use in various types of immunoassays, and particularly to a precision cutting instrument for slicing solid support sheets used in preparing immunoassay strips.

2. Brief Description of Prior Art

Recent advances in basic research techniques have produced highly sensitive diagnostic assays which are rapidly being refined for widespread use in hospitals, blood banks, and commercial laboratories. One such technique, commonly known as Western Blot analysis, is described in U.S. Pat. No. 4,452,991. By this technique, proteins which have been separated or otherwise dispersed in a gel are electrophoretically transferred to and immobilized upon solid support sheets, such as nitrocellulose sheets. Generally, when Western Blot analysis is used as a diagnostic tool, the solid support sheets are cut into strips which are then further treated and/or exposed to the sample to be tested.

Of particular significance is the use of Western Blot analysis to detect the presence in human serum of antibodies against a variety of disease related antigens. A commercial kit for detecting the presence of a particular antibody would necessarily contain strips of the solid support sheets to which proteins or antigens have been electrophoretically transferred. Currently, due to the delicate nature of the solid support sheets and the proteins immobilized thereon, the solid support sheets are cut into strips by hand using a sharp razor blade or similar tool. While this method of cutting solid support sheets is suitable for most basic research procedures requiring a relatively small number of strips, the commercial production of diagnostic test kits requires a means for rapidly and accurately slicing the solid support sheets to produce large volumes of identical strips which provide reliable and readily reproduced results.

Although many types of cutting devices are known in the prior art, none of these devices are suitable for use with the delicate materials required in current immunological technology. For instance, U.S. Pat. No. 2,409,203 discloses a device for slitting sheets of cellulosic or plastic film to enable the strips produced to be subjected to tests of elongation and tensile strength. However, the cellulosic material is secured to the device by tightening a clamp over each end of the material. Such clamps would be unsuitable for securing the delicate solid support sheets utilized in most immunoassays.

Thus, a need exists for a precision cutting instrument which can rapidly and accurately slice solid support sheets upon which proteins have been immobilized into strips which are suitable for use in the commercial production of diagnostic test kits.

SUMMARY OF THE INVENTION

The present invention provides a novel precision cutting instrument for slicing solid support sheets utilized in immunological assays. The precision cutting instrument includes a rectangular-shaped flat base plate having parallel longitudinal grooves located on the flat upper surface of the base plate. A rectangular-shaped flat top plate contains longitudinal parallel slots which run through the entire thickness of the top plate. The top plate is attached to the base plate at one transverse end by a hinge. A slicing mechanism for cutting the solid support sheet in wheel mounted and includes a plurality of cutting blades which are aligned with the parallel longitudinal grooves and parallel longitudinal slots. The cutting blades are mounted onto a blade holding assembly which consists of a series of spacer elements and two end pieces. In addition, the blade holder is provided with four separate sets of cutting edges so that when one set of cutting blade edges becomes dull, the holder may be rotated to position an unused set of cutting blade edges over the solid support sheet.

The slicing mechanism is secured to the cutting instrument by two hold-down bars which confine the wheel axle rods and are mounted above the top plate by means of four support elements. The blade holding assembly is mounted between the lower inside surfaces of two handle plates, and a slicer handle is mounted between the upper inside surfaces of the two handle plates. The slicing mechanism is suspended over the top plate by means of two pins which project outwardly from the outside surfaces of each of the handle plates. Each of the front pins is inserted into a slot located in the front of each of two axle plates and rests on a cylindrical spring mounted within the slot. Each of the rear pins rests on an indentation located at the rear of each of the axle plates. The axle plates also are provided with holes through which the axle rods pass before extending underneath the hold down bars. The wheels are attached to the axle rods outside the hold-down bars and roll in trackways defined by the base plate and the side edges of the top plate.

To operate the cutting instrument, an antigen-laden solid support sheet to be cut into strips is sandwiched between the longitudinal grooves of the base plate and the parallel slots of the top plate. The front end of the top plate is secured to the base plate by means of a locking element and catch. The slicer handle is pushed downwardly, causing the cylindrical springs to be compressed by the pressure exerted by the handle plate pins. The cutting blades are pressed through the parallel slots located in the top plate and into the parallel longitudinal grooves located in the upper surface of the base plate. While holding down on the handle, the slicing mechanism is moved longitudinally so that the blades pass through the slots of top plate, through the solid support sheet, and into the grooves of the base plate. After slicing, the handle is released to decompress the cylindrical spring in the axle plate slots, thereby raising the blades above the longitudinal grooves on the base plate and the solid support sheet, and partially above the longitudinal slots in the top plate. The slicing mechanism can then be returned to its original position without depressing the handle so that the blades are not passed through the solid support sheet in the opposite direction. The top plate is then unsecured and lifted from the base plate and the separate strips of the solid support sheet may be removed.

An important feature of the precision cutter of the present invention is its capacity to provide strips of the solid support sheets which are of equal widths to within 0.001 inch. In sharp contrast to the variability which unavoidably results from manual slicing, the high degree of accuracy provided by the present invention provides manufacturers of commercial diagnostic kits utilizing blot technology with a standard strip dimension so that the amount of antigen on each strip remains constant. The commercial diagnostic kits containing the standardized antigen-laden strips produce far more reliable results and, thus, are suitable for widespread use in detecting many diseases.

It is an object of the present invention to provide a precision cutting instrument which easily, reliably and precisely slices solid support sheets used in immunoassays into equivalent thin strips.

A further object of the present invention is to provide a precision cutting instrument which slices a solid support sheet in one direction and which, after slicing the strips, allows the slicing mechanism to be returned to its original position without passing the cutting edges through the solid support sheet in the opposite direction.

An additional object of the present invention is to provide a blade holder and blade apparatus which may be used in four different configurations to maximize the use of the blades positioned within the blade holder apparatus.

A further object of the present invention is to provide a cutting instrument which can slice solid support sheets into strips of different widths.

Other objects and features of the present invention will become apparent to those skilled in the art as the disclosure is made in the following description of a preferred embodiment of the present invention, as illustrated in the accompanying sheets of drawings.

BRIEF DESCRIPTION OF THE DRAWINGS

FIG. 1 is a top view of a precision cutting instrument which embodies the teachings of the instant invention.

FIG. 2 is a view taken along line 2—2 of FIG. 1.

FIG. 4 is a perspective view of the precision cutting instrument of FIG. 1.

FIG. 5 is a perspective view of the precision cutting instrument of FIG. 1 with the top plate raised from the base plate.

FIG. 9 is a view of a rubber foot which is attached to the base plate.

FIG. 10 is a view of a locking element catch with semicircular end engaged.

FIG. 11 is a side view of the locking element when top plate is secured to base plate.

DETAILED DESCRIPTION OF THE PREFERRED EMBODIMENT

Figure 3:
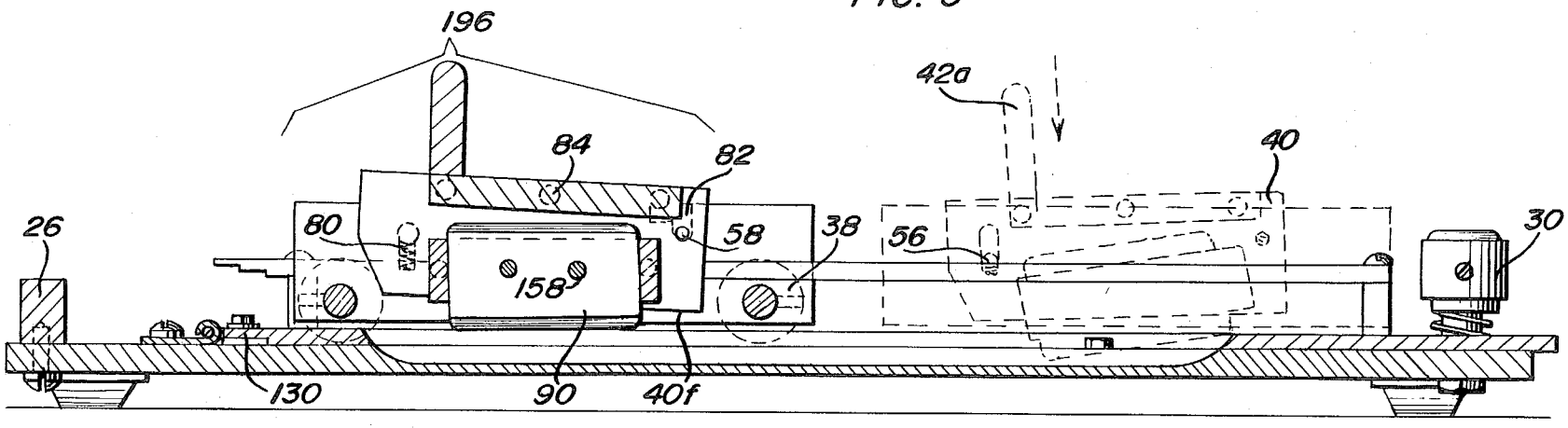
FIG. 3 is a view taken along line 3—3 of FIG. 1.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 8:
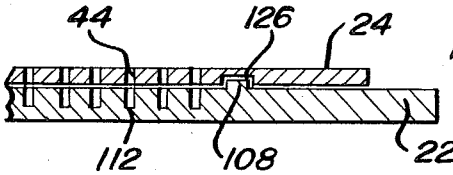
FIG. 8 is a view taken along line 8—8 of FIG. 4.

Referring now to the drawings, and more particularly to FIGS. 1 through 4, the basic elements of the precision cutting instrument of the present invention are collectively designated as 20 in FIG. 1. Generally, cutting instrument 20 comprises a rectangular-shaped base plate 22 which has parallel longitudinal grooves 112 on its substantially flat upper support surface as shown in FIGS. 2, 5 and 8. Hingedly mounted to base plate 22 is flat top sheet covering retainer plate 24 through which extend correspondingly aligned parallel longitudinal slots 44. The cutting instrument is designed so that slots 44 and grooves 112 are aligned when top plate 24 is positioned directly on top of base plate 22 as more clearly seen in FIGS. 2 and 8. Slicing mechanism 196 is secured to top plate 24 by means of two elongated hold-down bars 32, which are supported on the upper surface of top plate 24 by four support elements 78 (see FIG. 4).

Slicing mechanism 196 is roller mounted by cylindrical axle rods 36 which are supported through holes in rectangular-shaped axle plates 34, and underneath hold-down bars 32. Wheels 38 are mounted on the ends of axle rods 36 so that slicing mechanism 196 may be longitudinally moved across top plate 24. As shown in FIG. 1, wheels 38 travel along trackways 23 formed by the extension of base plate 22 beyond each of the edges **24*c* and 24*d* of top plate 24. Wheels 38 use the edges 24*c* and 24*d* of top plate 24 for alignment of slicing mechanism 196 as it is moved across top plate 24. Rectangular shaped handle plates 40 are mounted to axle plates 34 of slicing mechanism 196. Handle plates 40 act as mounting surfaces for an L-shaped handle 42 and a rectangular-shaped blade holder 92. Blade holder 92 includes a plurality of cutting blades 90 which align with slots 44 and grooves 112 when slicing mechanism 196 is assembled onto base plate 22**.

As shown in FIG. 1, base plate 22 includes back end **22*a*, front end 22*b*, and longitudinal sides 22*c* and 22*d*. Top plate 24 includes back end 24*a*, front end 24*b*, and longitudinal sides 24*c* and 24*d*. When top plate 24 is mounted onto base plate 22, ends 24*a* and 24*b* are parallel to back end 22*a* and front end 22*b*. Sides 24*c* and 24*d* are parallel to sides 22*c* and 22*d***.

Suitable fasteners, such as hinge screws 46, are inserted from the top side of base plate 22 to secure hinge 28 to base plate 22 in a position parallel to and near back end **22*a*. Hinge 28 is connected to top plate 24 by suitable fasteners, such as connecting screws 120 (see FIG. 5). Top plate 24 has recessed area 130 (see FIG. 3) at back end 24*a* so that the overall thickness of top plate 24 is the same as the thickness of recessed area 130, plus the thickness of hinge 28**.

Rectangular-shaped end handle 26 is attached to base plate 22, near back end **22*a*. End handle 26 is mounted parallel to back end 22*a* by any suitable fastener, such as by inserting screws 86 (see FIG. 3) through holes from the underside of base plate 22 near back end 22*a* into end handle 26**.

To secure top plate 24 to base plate 22 near front ends **22*b* and 24*b*, there is provided a locking element 30 located approximately half-way between sides 24*c* and 24*d* and slightly inward from front end 24*b*. A corresponding opening 64 is provided in base plate 22 for receiving locking element 30. Although a preferred locking mechanism is a quarter turn fastener such as shown in FIG. 11, any suitable means for securing top plate 24 to base plate 22** during the slicing or cutting operation may be utilized in the precision cutting instrument of this invention.

Referring again to FIGS. 1 and 4, hold-down bars 32 are mounted at each side above top plate 24 by means of support elements 78 (see FIG. 4). Hold-down bars 32 act as guide rails for slicing mechanism 196 and secure slicing mechanism 196 to top plate 24. Support elements 78 are connected to top plate 24 and hold-down bars 32 by suitable fasteners, such as countersunk screws 134 (see FIG. 5).

The back ends 33 of hold-down bars 32 extend beyond support elements 78 to maintain top plate 24 at a right angle to base plate 24 when top plate 24 is in a raised position by abutment with the base plate 22 Back end 33 of each hold-down bar 32 is provided with step-like identations (see FIG. 3) so that hold-down bars 32 clear hinge 28 when top plate 24 is in a raised position. Hold-down bars 32 and support elements 78 form elongated spaces 37 through which axle rods 36 pass, so that axle rods 36 are located below bars 32 and above top plate 24 (see FIG. 4).

Figure 6:
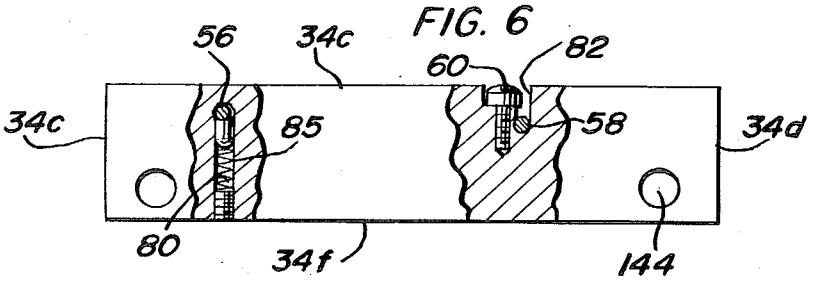
FIG. 6 is a view taken along line 6—6 of FIG. 1.

Axle rods 36 pass through axle plates 34 by means of holes 144 (see FIG. 6). Wheels 38 are mounted on and secured to the ends of axle rods 36 by wheel screws 54 (see FIG. 7), or by any other suitable securing method. Radial bores 88 are located on the lower half of the front and rear edges **34*c* and 34*d* of plates 34, and suitable fasteners such as screws 89 are inserted into bores 88 to further tighten the axle rods 36 to plates 34** (see FIG. 2).

Figure 7:
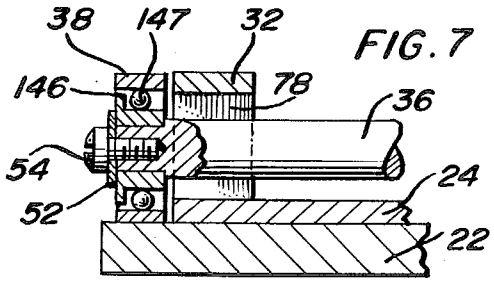
FIG. 7 is a view taken along line 7—7 of FIG. 1.

Referring to FIG. 7, the wheels 38 for moving slicing mechanism 196 are made of metal and have an inner movable ring 146. Ball bearings 147 are located outside of movable ring 146. In addition, the wheel 38 is provided with a hole bored throughout its thickness so that suitable fasteners, such as washers 52 and screws 54, may be inserted to secure wheels 38 to axles 36. Although the wheels 38 can be made of metal, hard plastic, or any other suitable material, it is preferable that wheels 38 be provided with suitable bearings to reduce friction and facilitate the smooth operation of slicing mechanism 196.

Axle rods 36 and wheels 38 transport slicing mechanism 196 across top plate 24. Edges **22*c* and 22*d* of the base plate 22 extend beyond edges 24*c* and 24*d* of the top plate 24 to form trackways 23 over which the wheels 38 travel when the slicing mechanism 196 is transported across top plate 24. The wheels 38 are aligned by edges 24*c* and 24*d* of top plate 24 as they move across trackways 23 on base plate 24. Further, the axle rods 36 cannot be longitudinally displaced beyond support elements 78 when the slicing mechanism 196** is moved in either a forward or rearward direction.

The axle plates 34 include back ends **34*c*, front ends 34*d*, and longitudinal sides 34*e* and 34*f* (see FIG. 6). Each axle plate 34 is provided with slot 80 and indentation 82. Slots 80 are located between sides 34*e* and 34*f* towards back end 34*c*, with slots 80 being inward approximately one-fourth the distance from back end 34*c*. The indentations 82 are located on longitudinal sides 34*e* towards front end 34*d*, with indentations 82 being inward approximately one-fourth longitudinally from front end 34*d*. Handle plates 40 are connected to the axle plates 34 by the insertion of handle plate pins 56 and 58 into the slots 80 (see FIG. 6) and indentations 82**, respectively (see FIG. 6).

Coil springs 85 by our seated in the slots 80 of plates 34 with the upper part of the spring 85 extending approximately half-way into slot 80 when spring 85 is not compressed (see FIG. 6). Pins 56 rest on the springs 85. Screws 60 are screwed into plates 34 (see FIG. 6). The size of the head of screws 60 is such that each screw overlaps the vertical space located directly above pins 58, so that the pins 58 cannot be vertically displaced beyond the lower surface of the head of the screws 60.

Figure 15:
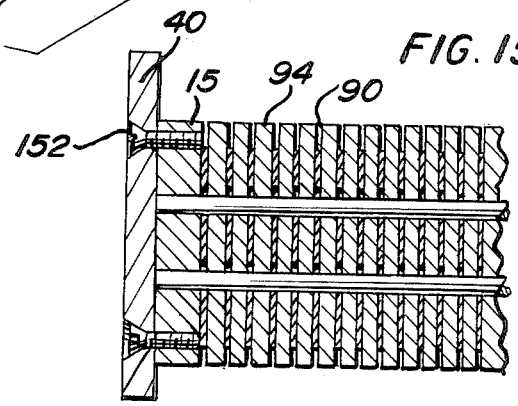
FIG. 15 is a top view of the blade holder of FIG. 14 when attached to a handle plate.

Handle plates 40 include back ends **40*c*, front ends 40*d*, upper longitudinal sides 40*e*, and lower longitudinal sides 40*f* (see FIGS. 15 and 4). The handle 42 is connected to the handle plates 40 along sides 40*e* by screws 84 or by any other suitable securing method (see FIG. 4). Handle 42 is mounted in such a manner that the shorter end 42*a* of L-shaped member 42 projects upward from the handle plates 40. In a preferred embodiment, screws 84 are countersunk into the handle plates 40**.

Figure 14:
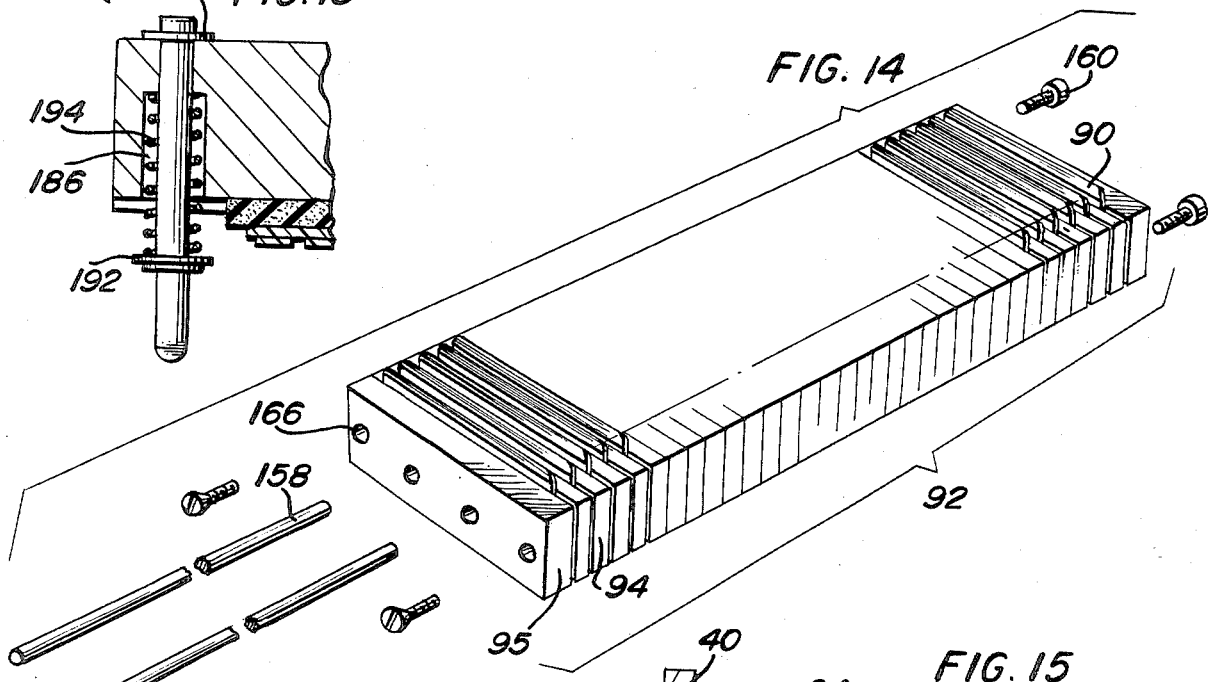
FIG. 14 is a perspective view of a blade holder used in connection with the instant invention.

As shown in FIG. 15, blade holder 92 is attached to the handle plates 40 by inserting countersunk screws 152 into holes located through handle plates 40 near sides **40*e* and 40*f*, and into holes located on the longitudinal faces of end pieces 95. The blade holder 92 includes two rectangular-shaped end pieces 95 and multiple rectangular-shaped spacers 94 (see FIGS. 14 and 15). Referring to FIGS. 14–15, the blade holder 92, with blades 90, is constructed by connecting a first end piece 95 to a plurality of spacers 94 wherein the blades 90 are inserted before and after each spacer 94. A second end piece 95 is connected to the final spacer 94 by means of alignment shafts 158, which pass through alignment holes 166 located in each end piece 95, spacer 94, and blade 90. Each spacer 94, blade 90, and end piece 95 preferably is provided with at least two alignment holes 166, so that two alignment shafts 158 can be utilized to assemble the blade holder 92. Alignment shafts 158 are provided with holes located at opposite transverse ends 156 where suitable fasteners, such as screws 160, are inserted to secure the blade holder 92. In a preferred embodiment, holes 166 are countersunk so that the screws 160 are mounted flush to the outer longitudinal surface of each end piece 95, or slightly recessed into the outer longitudinal surface of each end piece 95**.

If the cutting edges of blades 90 become dull due to continued use, the blade holder 92 and blades 90 may be repositioned to expose a new sharp cutting edge of the same blades 90 by first unscrewing screws 60 so that pins 58 are not obstructed during the changing operation. The shorter end **42*a* of handle 42 is then rotated counterclockwise about pivots 84 until the top of handle 42 is positioned on the upper face of top plate 24 near the back end 24*a* as shown by dotted line in FIG. 3. The blade holder 92, with blades 90, is unfastened by removing screws 152 from handle plates 40**.

Blade holder 92 can then be removed and may be repositioned by either (a) rotating blade holder 92 horizontally 180 degrees to allow the use of the opposite end of the same edge of the blades 90 which had been used before, or (b) turning the blade holder 92 over 180 degrees to place the opposite edge of blades 90 in the operative position. Holder 92 is then refastened to handle plates 40. Handle 42 is rotated until pins 58 rest in indentations 82. The screws 60 are resecured into indentations 82 and slicer 20 is ready to cut additional support sheets.

By using each side of each edge of the blades 90, and by using both edges of double edge blades, the symmetrical structure allows holder 92 to be positioned in four different configurations before blades 90 need changing. The final width of the strips is dependent on the width of slots 44, grooves 112, and spacers 94. According to a preferred embodiment, slots 44, grooves 112, and blades 90 are spaced either 3 or 4 millimeters apart. However, the space between each of the slots 44, grooves 112, and blades 90 may be designed according to the size desired by the user so long as the high degree of accuracy in producing equivalent strips is maintained. In an alternate embodiment, spacers 94 are made of a compressible material which allows blades 90 to be automatically aligned at any exact distance from one another by utilizing alignment shafts of a precise length. In a further embodiment, blade holder 92 is provided with a protective covering, such as heat molded plastic, over the longitudinal edges of blades 90 which are not in use during operation of slicing mechanism 196.

In addition, any number of strips and strip widths can be obtained in accordance with the structure of this invention by varying the size, number and position of the spacers 94 and blades 90 within the end plates. It is only necessary that blades 90 be aligned to extend through slots 44 and into grooves 112 for cutting the sheet positioned between top plate 24 and base plate 22. Although double-edged razor blades are the preferred cutting blades, any suitable cutting edge may be utilized in the blade holder of the present invention. However, blades 90 should have a thickness of no more than 0.004 inch to prevent distortion of the solid support sheet.

Grooves 112 are located in the center of base plate 22 and run parallel to the longer sides of base plate 22. The grooves 112 do not extend throughout the entire thickness of base plate 22 (see FIGS. 2, 5). However, parallel slots 44 in top plate 24 extend throughout the entire thickness of top plate 24 to allow blades 90 to pass through top plate 24. Slots 44 are aligned with grooves 112 to form channels for guiding cutting blades 90 through a solid support sheet positioned between the base plate 22 and top plate 24 so that the solid support sheet is sliced into a number of equivalent strips (see FIG. 2).

Referring to FIG. 5, the upper surface of base plate 22 is provided with longitudinal bar groove 109, generally parallel to and near one longer edge **22*d* of base plate 22. Raised bar 108 is mounted within bar groove 109. The upper surface of base plate 22 also is provided with bar groove 113 having raised bar 110 mounted therein. Raised bar 110 and bar groove 113 are located within and perpendicular to grooves 112 in base plate 22. Bar groove 113 is positioned at a right angle to bar groove 109. In addition, slots 111 are provided on bar 110 which align with and correspond to grooves 112 in base plate 22**.

The lower surface of top plate 24 is provided with groove 126 and groove 128 which correspond to and align with raised bar 108 and raised bar 110, respectively, when top plate 24 is properly aligned with and secured over base plate 22 to prevent any movement of top plate 24 when the slicing mechanism 196 is in operation. (see FIGS. 5, 8). Groove 128 is designed so that slots 44 pass through the excavated area without any change in the direction of slots 44. In addition, bars 108 and 110 serve to properly align the support sheet over grooves 112 on the surface of base plate 22 so that blades 90 will slice the support sheet into multiple strips of equal widths.

When handle 42 is in a raised position, the lower edges of blades 90 are located between the upper and lower surfaces of top plate 24 (see FIG. 2). Further, as shown in FIG. 3, when slicer handle 42 is in a raised position, pins 56 and 58 are generally parallel to one another, with the pins 56 resting on springs 85.

When handle 42 is depressed in the direction indicated by arrow A in FIG. 3, several visible differences are present, as shown in phantom in FIG. 3. First, spring 85 is compressed and the pins 56 are now lower than, as opposed to parallel with, pins 58. Additionally, the blades 90 pass through slots 44 of top plate 24 and into grooves 112 of base plate 22 at an inclined angle relative to the base plate 22. The transverse sides of blade holder 92 are also at the same angle.

Referring to FIG. 2, rubber feet 62 are mounted to the lower surface of base plate 22. In a preferred embodiment, four rubber feet 62 are mounted near each corner of the lower surface of base plate 22 to allow the slicer 20 to securely rest on a table or counter top.

Figure 12:
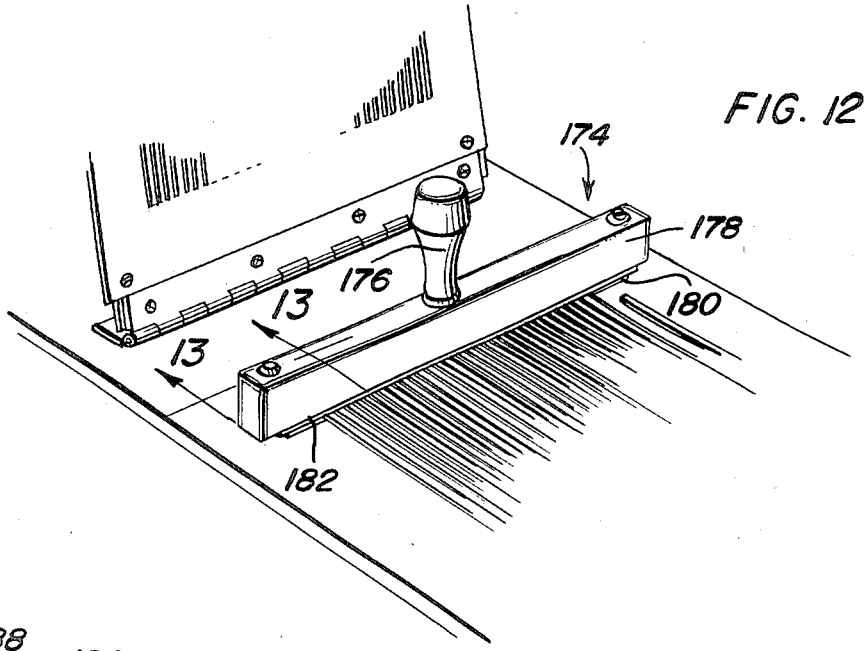
FIG. 12 shows a stamp for marking a solid support sheet to be sliced.
Figure 13:
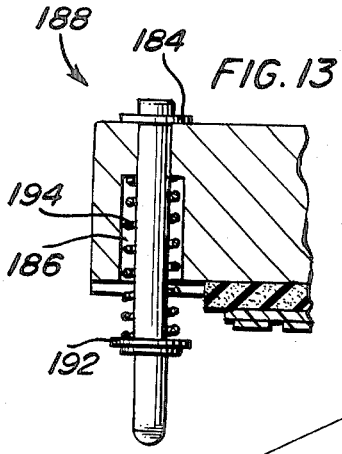
FIG. 13 is a view taken along line 13—13 of FIG. 12.

In order to identify each individual strip after slicing, a stamp 174 is used for marking a solid support sheet prior to being sliced into strips. Referring to FIGS. 12 and 13, the stamp 174 includes stamp handle 176 which is mounted to stamp body 178 in any suitable manner, stamping element 180, and stamping element connecting layer 182, by which the stamping element 180 is attached to the stamp body 178. Stamp 174 also has pin holes 184 and enlarged pin holes 186 located towards each transverse end of stamp body 178. Vertical pins 188 are provided with circular grooves for retaining pin washers 192, and pin coil springs 194. A vertical pin 188 is inserted into each pin hole 184 in stamp 174 for aligning stamp 174 over a solid support sheet placed on the base plate 22. Base plate 22 is provided with stamp holes 104 as shown in FIG. 5 for receiving the vertical pins 188. Each of stamp holes 104 is located approximately one-third inward from back end **22*a* and approximately one-sixth inward transversely from sides 22*c* and 22*d***, respectively.

To operate stamp 174, the lower ends of the pins 188 are inserted into the stamp holes 104 in the upper surface of the base plate 22 (see FIG. 5). Stamp handle 176 is pushed downward to compress springs 194, causing stamping element 180 to place a stamp or marking upon the solid support sheet to be sliced. Although only stamp 174 has been described herein, it is understood that any suitable means for marking the solid support sheet may be utilized with the precision cutter of the present invention.

To operate slicer 20, a rectangular-shaped antigen-laden solid support sheet is placed on top of grooves 112 of the base plate 22. The support sheet should not extend beyond the raised bars 108 and 110. The support sheet is marked for identification by using the stamp 174 as described above. The top plate 24 is then swung into position on the top of the sheet and aligned with the base plate by means of the grooves 126 and 128 in top plate 24 mating with the raised bars 108 and 110 in the base plate 22, respectively. The front end of the top plate is then secured to the base plate by locking element 30. At this time, the slicing mechanism 196 should be in a raised position near the back end **22*a* of base plate 22**.

The shorter side **42*a* of L-shaped handle 42 then is pressed downward, causing blade holder 92 to move downward. One end of the lower longitudinal edges of blades 90 is inserted through slots 44 of the top plate 24, and into the grooves 112 in base plate 22. While continuing to exert downward pressure on handle 42, slicing mechanism 196 is pushed longitudinally towards front end 24*b* so that wheels 38 travel along trackways 23 on base plate 22, near the edges of sides 24*c* and 24*d* of the top plate 24, and near the edges of sides 32*e*** and 32*f* of the bars 32*a* and 32*b*, respectively. The wheels 38 and axle rods 36 are guided by top plate 24 and edges 24*c* and 24*d* to ensure a straight, steady slicing motion. The slicing mechanism 196 is pushed longitudinally until the wheels 38 can no longer advance when one of the axle rods 36 abuts support elements 78 located near the front end 24*a*.

While the handle 42 is pressed downward and slicing mechanism 196 is pushed longitudinally, the blades 90 pass through slots 44 of top plate 24, slice through the support sheet, and travel along the grooves 112 of base plate 22. In a preferred embodiment of the invention, 31 blades are used to obtain 32 strips, 31 of which are of equal width.

Upon releasing handle 42, springs 85 expand and push pins 56 upward, thereby causing the blades 90 to become disengaged from grooves 112. With the handle 42 in a released position, the slicing mechanism 196 is pushed back towards end 24*a* by means of the wheels 38. The slicing mechanism 196 cannot be pushed further towards back end 24*a* when one of axle rods 36 abuts support elements 78 near back end 24*a*. Because blades 90 are disengaged with grooves 112 and are raised above the sliced solid support sheet, the blades 90 do not cut or contact the sliced strips of the support sheet.

After the slicing mechanism 196 is returned to its original position, the locking mechanism 30 is disengaged and top plate 24 is lifted from base plate 22 by hinge 28 until extended ends 33 of hold-down bars 32 contact base plate 22 near the back end 22*a*. The strips may then be removed, preferably by using tweezers or a similar tool, for further use in an immunoassay.

From the above, it is apparent that many modifications and variations of the present invention are possible in light of the above teachings. It is, therefore, to be understood that, within the scope of the appended claims, the invention may be practiced otherwise than as specifically described.

What is claimed is:

1. An apparatus for cutting a solid sheet into multiple strips which comprises: a base plate having parallel longitudinal grooves located on its upper surface on which the solid sheet can be placed; a top plate having parallel longitudinal slots extending therethrough; positioning means for positioning said top plate with respect to said base plate so that said parallel longitudinal slots of said top plate overlay and register with said parallel longitudinal grooves of said base plate; a plurality of cutting elements; holding means for holding said cutting elements; and transport means for moving said holder longitudinally and said cutting elements through said parallel longitudinal slots of said top plate, through said solid sheet, and into the parallel longitudinal grooves of said base plate whereby said sheet can be cut into a predetermined number of equivalent longitudinal strips, said transport means including a wheel assembly which rolls in a pair of trackways defined by the top plate and the base plate.

2. An apparatus for cutting a solid sheet into multiple strips which comprises: a base plate having an upper surface within which longitudinal grooves are formed and on which the solid sheet is received; a top plate having longitudinal slots extending therethrough; means for positioning said top plate in operative relation to said base plate covering the solid sheet received thereon with said longitudinal slots of said top plate overlying and in registry with said longitudinal grooves of said base plate; a plurality of cutting elements; means for holding said cutting elements; transport means for imparting relative longitudinal movement between said holding means and said base plate with the cutting elements projecting through said longitudinal slots of said top plate and through said solid sheet into the longitudinal grooves of said base plate whereby said sheet is cut into a predetermined number of equivalent longitudinal strips, aligning means on the base plate and stamp means engageable with the aligning means on the base plate in operative relation to the grooves for marking the solid sheet before cutting.

3. An apparatus for cutting a solid sheet into multiple strips which comprises: a base plate on which the solid sheet can be placed and having a track way means thereon; a top plate having slots extending therethrough and adapted to be positioned on top of said base plate; a plurality of cutting elements secured within a holding means; and transport means for moving said holding means across the top plate and said cutting elements through said slots whereby said sheet can be cut into a predetermined number of strips, said transport means including wheel means rolling upon said track means, the side edges of the top plate cooperating with the track way means on the base plate to keep the transport means properly aligned during movement.

4. A precision cutting implement for slicing a sheet into multiple strips, including a base having spaced grooves therein, a sheet covering retainer having spaced slots extending therethrough, means displaceably mounting the retainer with the grooves and the slots in alignment for holding the sheet on the base, blade means movably carried by the retainer for projection through the slots therein, means for selectively displacing the blade means from the slots through the sheet into the grooves, guide means responsive to reception of said blade means in the grooves for guiding movement thereof parallel to the grooves and slicing means operatively interconnecting the selective displacing means and the guide means through which said movement is imparted to the blade means for effecting said slicing of the sheet by the blade means into the multiple strips exclusively in response to said movement of the blade means in the grooves.

5. The combination of claim 4 wherein said guiding means includes a track formed on the base and roller means mounted on the slicing means for engagement with the track while the blade means is received in the grooves.

6. The combination of claim 5 wherein said selective displacing means includes means for biasing the blade means to a position within the slots retracted from the grooves and handle means connected to the slicing means for pivoting the blade means to an operative position within the grooves accommodating said guided movement thereof.

7. The combination of claim 4 wherein said selective displacing means includes means for biasing the blade means to a position within the slots retracted from the grooves and handle means connected to the slicing means for pivoting the blade means to an operative position within the grooves accommodating said guided movement thereof.

* * * * *